US008079815B2

(12) United States Patent
Hada et al.

(10) Patent No.: US 8,079,815 B2
(45) Date of Patent: Dec. 20, 2011

(54) TURBINE BLADE

(75) Inventors: Satoshi Hada, Takasago (JP); Tomoko Hashimoto, Takasago (JP); Masanori Yuri, Takasago (JP); Keizo Tsukagoshi, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 93 days.

(21) Appl. No.: 12/633,842

(22) Filed: Dec. 9, 2009

(65) Prior Publication Data

US 2010/0150734 A1 Jun. 17, 2010

Related U.S. Application Data

(63) Continuation of application No. PCT/JP2008/063242, filed on Jul. 24, 2008.

(30) Foreign Application Priority Data

Jul. 31, 2007 (WO) ..... PCT/JP2007/065017

(51) Int. Cl.
*F01D 5/18* (2006.01)

(52) U.S. Cl. ..... 416/97 R

(58) Field of Classification Search ..... 415/115; 416/97 R, 97 A
See application file for complete search history.

(56) References Cited

U.S. PATENT DOCUMENTS 3,700,418 A * 10/1972 Mayeda ..... 428/613
4,021,139 A 5/1977 Franklin
4,118,146 A * 10/1978 Dierberger ..... 416/97 A
4,153,386 A * 5/1979 Leogrande et al. ..... 415/115
4,312,624 A 1/1982 Steinbauer, Jr. et al.
5,120,192 A * 6/1992 Ohtomo et al. ..... 415/115
5,176,499 A * 1/1993 Damlis et al. ..... 416/97 R
5,645,397 A 7/1997 Soechting et al.
5,779,437 A * 7/1998 Abdel-Messeh et al. ..... 415/115
6,283,708 B1 * 9/2001 Zelesky ..... 416/97 R
6,402,471 B1 6/2002 Demers et al.
6,705,836 B2 * 3/2004 Bourriaud et al. ..... 416/97 R
6,742,991 B2 * 6/2004 Soechting et al. ..... 416/97 R
7,097,426 B2 8/2006 Lee et al.

(Continued)

FOREIGN PATENT DOCUMENTS

JP 51-069708 A 6/1976

(Continued)

OTHER PUBLICATIONS

International Search Report of PCT/JP2008/063242, mailing date of Aug. 19, 2008. Japanese Office Action dated Jul. 19, 2011, issued in corresponding Japanese Patent Application No. 2009-525359.

*Primary Examiner* — Edward Look
*Assistant Examiner* — Aaron R Eastman
(74) *Attorney, Agent, or Firm* — Westerman, Hattori, Daniels & Adrian, LLP

(57) ABSTRACT

In a turbine blade in which a tabular rib partitioning the blade into a pressure side and a suction side is provided in substantially the midsection of the blade along a center line connecting a leading edge and a trailing edge, and at least two cavities of which a cavity at the suction side and a cavity at the pressure side do not communicate with each other are provided, a pressure adjustment member for cooling air flowing into and out of the cavity at the suction side reduces the amount of cooling air flowing into the suction side, relative to the pressure side.

4 Claims, 7 Drawing Sheets

U.S. PATENT DOCUMENTS

| | | | | |
|---|---|---|---|---|
| 7,128,533 | B2 | 10/2006 | Liang | |
| 7,497,655 | B1 * | 3/2009 | Liang | 415/1 |
| 7,556,476 | B1 * | 7/2009 | Liang | 416/97 R |
| 2001/0021343 | A1 | 9/2001 | Kuwabara et al. | |
| 2003/0044277 | A1 * | 3/2003 | Bourriaud et al. | 416/97 R |
| 2003/0170113 | A1 | 9/2003 | Burdgick et al. | |
| 2005/0226726 | A1 | 10/2005 | Lee et al. | |
| 2006/0056967 | A1 * | 3/2006 | Liang | 416/97 R |
| 2006/0222495 | A1 * | 10/2006 | Liang | 416/97 R |
| 2007/0116570 | A1 * | 5/2007 | Boury et al. | 416/97 R |
| 2007/0122282 | A1 * | 5/2007 | Deschamps et al. | 416/97 R |
| 2007/0128031 | A1 * | 6/2007 | Liang | 416/97 R |
| 2009/0104042 | A1 * | 4/2009 | Liang | 416/97 R |
| 2010/0221121 | A1 * | 9/2010 | Liang | 416/97 R |

FOREIGN PATENT DOCUMENTS

| | | | |
|---|---|---|---|
| JP | 62-024606 | A | 2/1987 |
| JP | 09-041903 | A | 2/1997 |
| JP | 09-112205 | A | 4/1997 |
| JP | 09-303103 | A | 11/1997 |
| JP | 2001-012205 | A | 1/2001 |
| JP | 2001-254605 | A | 9/2001 |
| JP | 2002-242607 | A | 8/2002 |
| JP | 2003-286805 | A | 10/2003 |
| JP | 2005-299636 | A | 10/2005 |
| JP | 2007-002843 | A | 1/2007 |

* cited by examiner

TURBINE BLADE

TECHNICAL FIELD

The present invention relates to gas turbines, and more specifically, to turbine blades (blades/vanes) of gas turbines.

BACKGROUND ART

Patent Document 1 discloses a known example of a turbine blade (vane) in a turbine unit of a gas turbine.

Patent Document 1:

Japanese Unexamined Patent Application, Publication No. 2001-254605

Patent Document 2 also discloses a gas-turbine blade having a dedicated fluid passage for film-cooling at a pressure side.

Patent Document 2:

Japanese Examined Patent Application, Publication No. Sho 62-24606

In addition, Patent Document 3 discloses a known cooling structure that particularly copes with thermal load on a blade surface of a gas turbine.

Patent Document 3:

Japanese Unexamined Patent Application, Publication No. 2002-242607

DISCLOSURE OF INVENTION

However, in the turbine blade disclosed in Patent Document 1, since the environment surrounding the gas turbine blade during operation is such that the pressure on the surface at the suction side (convex side) of the air foil is lower than the pressure on the surface at the pressure side (concave side) of the blade, cooling air introduced into an insert flows more towards the suction side through the suction side film-cooling holes, where the pressure is lower. For this reason, in order to ensure a minimum required flow rate of cooling air for cooling the pressure side, it is necessary to increase the flow rate of cooling air to be introduced. There is a problem in terms of lower turbine efficiency because excessive cooling air flows to the suction side of the air foil, causing wasted cooling air to become mixed with combustion gas and thus lowering the temperature of the gas that rotates the turbine.

Although the amount of wasted cooling air can conceivably be decreased by reducing the hole diameter of an impingement plate at the suction side inside the air foil or the hole diameter of film-cooling holes of the air foil, this is problematic in that it leads to difficulty in manufacturing and to clogging of the holes by dust. Furthermore, although the hole diameter of the impingement plate at the suction side can conceivably be the same as that at the pressure side but be reduced in number, this is problematic in that it makes uniform cooling difficult because of the hole distribution of the impingement plate.

With the structure disclosed in Patent Document 2, it is impossible to cope with a reduction in the thickness of the turbine blade, resulting in a lower cooling effect.

With the structure disclosed in Patent Document 3, the blade structure is complex, which results in an increase in the cost of the turbine.

The present invention has been conceived in light of the circumstances described above, and an object thereof is to provide a turbine blade that can reduce the amount of cooling air (cooling medium) to be used by eliminating wasted cooling air flowing to the suction side (convex side) of the air foil, can effectively cope with a reduction in blade thickness, and can be particularly applied to a high-temperature combustion turbine of 1500° C. or higher for better efficiency of the gas turbine.

In order to solve the aforementioned problems, the present invention provides the following solutions.

A turbine blade according to the present invention includes an air foil provided with a plurality of film-cooling holes, a tabular rib provided between a leading edge and a trailing edge and partitioning the blade into a pressure side and a suction side along a center line connecting the leading edge and the trailing edge, and at least two cavities of which a cavity at the suction side and a cavity at the pressure side do not communicate with each other; and a first impingement plate and/or a second impingement plate, the first impingement plate being disposed within one of the cavities such that a cooling space is formed between an outer peripheral surface thereof and an inner peripheral surface of the air foil, the first impingement plate functioning as a pressure adjustment member and being provided with a plurality of impingement-cooling holes. The second impingement plate is disposed within a shroud. The turbine blade employs a technique in which the pressure of cooling air flowing into and out of the cavity at the suction side is made lower than the pressure of cooling air at the pressure side by means of the first impingement plate and/or the second impingement plate so as to reduce wasted cooling air flowing to the suction side (convex side) of the air foil and thus reduce the overall amount of cooling air (cooling medium) to be used, whereby the reduced air amount intended for a further increase in output.

With the turbine blade according to the present invention, the first and second impingement plates functioning as pressure adjustment members allow for an increase in channel resistance against cooling air that tries to flow through spaces in the cavities from the pressure side (concave side) to the suction side (convex side) of the air foil so that the cooling air (cooling medium) flowing towards the suction side is reduced, thereby reducing the amount of cooling air to be used.

Furthermore, with the turbine blade according to the present invention, cooling air with low pressure and low flow velocity is, for example, blown out from the film-cooling holes formed at the suction side of a cavity located in the midsection so that a highly persistent cooling air film is uniformly formed along the outer wall surface at the suction side of the air foil.

Consequently, the heat transfer from the combustion gas (high-temperature gas) to the surface of the air foil (more specifically, the outer wall surface at the suction side of the air foil) can be reduced, thereby improving the film cooling efficiency.

The turbine blade is provided with a second tabular rib that partitions the spaces within the cavities into the pressure side and the suction side along the center line and does not allow the spaces to communicate with each other. This is significantly advantageous because the pressure fluctuation within the cavity at the pressure side does not affect the pressure within the cavity at the suction side during operation. Moreover, the second rib could minimize the pressure difference between the pressure side and the suction side. In particular, at the suction side, the second rib is advantageous in that it can compensate for strength reduction caused by weight reduction of the blade and thickness reduction intended for improving the cooling effect.

According to such a turbine blade, there is no cooling air that tries to flow through the spaces within the cavities from the pressure-side cavity to the suction-side cavity of the air foil so that an optimal amount of cooling air flows to the suction side, thereby ultimately reducing the amount of cooling air to be used during operation of the turbine.

The turbine blade more preferably includes a second impingement plate having a plurality of impingement-cooling holes and disposed upstream of a space located at the suction side of the second rib, such that a cooling medium passing through the impingement-cooling holes formed in the second impingement plate is introduced into the space located at the suction side of the second rib.

According to such a turbine blade, cooling air supplied (blown out) towards the second impingement plate impingement-cools the second impingement plate and then passes through the impingement-cooling holes formed in the second impingement plate. Subsequently, as shown in FIGS. 2 and 3, for example, the cooling air travels through cooling spaces formed between an inner wall surface of the second impingement plate and a surface of an inner shroud and between the inner wall surface of the second impingement plate and a surface of the outer shroud and flows into a space formed, at the suction side of a cavity located in the midsection, by a wall surface of the first rib, a wall surface of the second rib, and an inner wall surface of the first impingement plate. The cooling air flowing into the space formed, at the suction side of the cavity, by the wall surface of the first rib, the wall surface of the second rib, and the inner wall surface of the first impingement plate is blown into a cooling space provided at the suction side of the cavity and formed by an outer wall surface of the first impingement plate, the wall surface of the first rib, and an inner wall surface at the suction side of the air foil through impingement-cooling holes that are open towards the inner wall surface at the suction side of the air foil, so as to impingement-cool the inner wall surface at the suction side of the air foil. Subsequently, the cooling air is blown out from the film-cooling holes.

Specifically, the cooling air, after impingement-cooling the second impingement plate, is used for impingement-cooling the inner wall surface at the suction side of the air foil, as well as for film-cooling the outer wall surface (outer peripheral surface) at the suction side of the air foil without affecting the cooling of the pressure side.

Accordingly, for example, the amount of cooling air flowing into the space formed, at the suction side of the cavity located in the midsection, by the wall surface of the first rib, the wall surface of the second rib, and the inner wall surface of the first impingement plate can be reduced, whereby the overall amount of cooling air (consumption level of cooling air) can be reduced. In addition, low-temperature cooling air that does not contribute to the cooling of the blade is prevented from being blown out from the film-cooling holes.

A turbine blade according to another aspect of the present invention includes a air foil provided with a plurality of film-cooling holes and at least two cavities formed therein by at least one first tabular rib provided substantially orthogonally to a center line connecting a leading edge and a trailing edge in a cross section taken substantially orthogonally to an axis extending in the vertical direction; and a first impingement plate disposed within one of the cavities such that a cooling space is formed between an outer peripheral surface thereof and an inner peripheral surface of the air foil and provided with a plurality of impingement-cooling holes.

With the turbine blade according to this invention, the first impingement plate allows for an increase in channel resistance against cooling air that tries to flow through spaces in the cavities from the pressure side (concave side) to the suction side (convex side) of the air foil so that the cooling air (cooling medium) flowing to the suction side is reduced, thereby reducing the amount of cooling air to be used.

Furthermore, with the turbine blade according to this invention, cooling air with low pressure and low flow velocity is, for example, blown out from the film-cooling holes formed at the suction side of a cavity located in the midsection so that a highly persistent cooling air film is uniformly formed along the outer wall surface at the suction side of the air foil.

Consequently, the heat transmission from the combustion gas (high-temperature gas) to the surface of the air foil (more specifically, the outer wall surface at the suction side of the air foil) can be reduced, thereby improving the film cooling efficiency.

The turbine blade is more preferably provided with a second tabular rib that partitions the spaces within the cavities into the pressure side and the suction side along the center line.

According to such a turbine blade, the channel resistance against cooling air that tries to flow through the spaces in the cavities from the pressure side to the suction side of the air foil is further increased so that the cooling air flowing towards the suction side is further reduced, thereby further reducing the amount of cooling air to be used.

The turbine blade more preferably includes a second impingement plate having a plurality of impingement-cooling holes and disposed upstream of a space located at the suction side of the second rib, such that a cooling medium passing through the impingement-cooling holes formed in the second impingement plate is introduced into the space located at the suction side of the second rib.

According to such a turbine blade, cooling air supplied (blown out) towards the second impingement plate impingement-cools the second impingement plate and then passes through the impingement-cooling holes formed in the second impingement plate. Subsequently, as shown in FIGS. 2 and 3, for example, the cooling air travels through cooling spaces formed between an inner wall surface of the second impingement plate and a surface of an inner shroud and between the inner wall surface of the second impingement plate and a surface of an outer shroud and flows into a space formed, at the suction side of a cavity located in the midsection, by a wall surface of the first rib, a wall surface of the second rib, and an inner wall surface of the first impingement plate. The cooling air flowing into the space formed, at the suction side of the cavity, by the wall surface of the first rib, the wall surface of the second rib, and the inner wall surface of the first impingement plate is blown into a cooling space provided at the suction side of the cavity and formed by an outer wall surface of the first impingement plate, the wall surface of the first rib, and an inner wall surface at the suction side of the air foil through impingement-cooling holes that are open towards the inner wall surface at the suction side of the air foil, so as to impingement-cool the inner wall surface at the suction side of the air foil. Subsequently, the cooling air is blown out from the film-cooling holes.

Specifically, the cooling air, after impingement-cooling the second impingement plate, is used for impingement-cooling the inner wall surface at the suction side of the air foil, as well as for film-cooling the outer wall surface (outer peripheral surface) at the suction side of the air foil.

Accordingly, for example, the amount of cooling air flowing into the space formed, at the suction side of the cavity located in the midsection, by the wall surface of the first rib, the wall surface of the second rib, and the inner wall surface of the first impingement plate can be reduced, whereby the overall amount of cooling air (consumption level of cooling air) can be reduced. In addition, low-temperature cooling air is prevented from being blown out from the film-cooling holes.

In the turbine blade according to the present invention, a tabular rib partitioning the blade into a pressure side and a suction side along a center line connecting a leading edge and a trailing edge is provided between the leading edge and the trailing edge, and at least two cavities are provided, of which a cavity at the suction side and a cavity at the pressure side do not communicate with each other.

A passage for cooling air supplied to the cavity at the suction side includes pressure adjustment members constituted by a second impingement plate formed upstream in the flow direction of the cooling air and provided on surfaces of an inner shroud and an outer shroud and a first impingement plate formed downstream of the suction side cavity as viewed in the flow direction of the cooling air and located adjacent to an inner wall surface at the suction side of the air foil.

A passage for cooling air supplied to the cavity at the pressure side includes a first impingement plate serving as a pressure adjustment member and located adjacent to the inner wall surface at the suction side of the air foil, and preferably has a configuration in which cooling air is directly supplied into the pressure side cavity from the inner shroud and the outer shroud without intervention of the second impingement plate provided on the inner shroud and the outer shroud.

With such a turbine blade, since the pressure adjustment member in the passage for cooling air supplied to the pressure side cavity is constituted only by a first impingement plate, whereas the pressure adjustment member in the passage for cooling air supplied to the suction side cavity is constituted by a first impingement plate and a second impingement plate, the number of pressure adjustment members in the passage for cooling air at the pressure side is smaller than that at the suction side. Because the passage for cooling air supplied to the suction side cavity is decompressed by the first impingement plate and the second impingement plate, the pressure in the suction side cavity becomes lower than the pressure in the pressure side cavity. As a result, the amount of cooling air supplied to the suction side cavity and discharged from the film-cooling hole at the suction side of the air foil is reduced.

A gas turbine according to the present invention includes a turbine blade that can reduce the overall amount of cooling air and can prevent low-temperature cooling air from being excessively blown out from film-cooling holes.

With the gas turbine according to the present invention, because the overall amount of cooling air is reduced, the amount of air extracted from a compressor of a previous stage of the turbine is reduced so that a greater amount of air to be used for combustion can be supplied to a combustor. Therefore, the amount of combustion gas in the gas turbine can be increased so as to allow for enhanced performance (output) and prevent unnecessary blow-out of low-temperature cooling air from the film-cooling holes, thereby improving the thermal efficiency of the gas turbine.

According to the present invention, wasted cooling air that flows toward the suction side (convex side) of the air foil is reduced so that the amount of cooling air (cooling medium) to be used can advantageously be reduced.

EXPLANATION OF REFERENCE SIGNS

Figure 1:
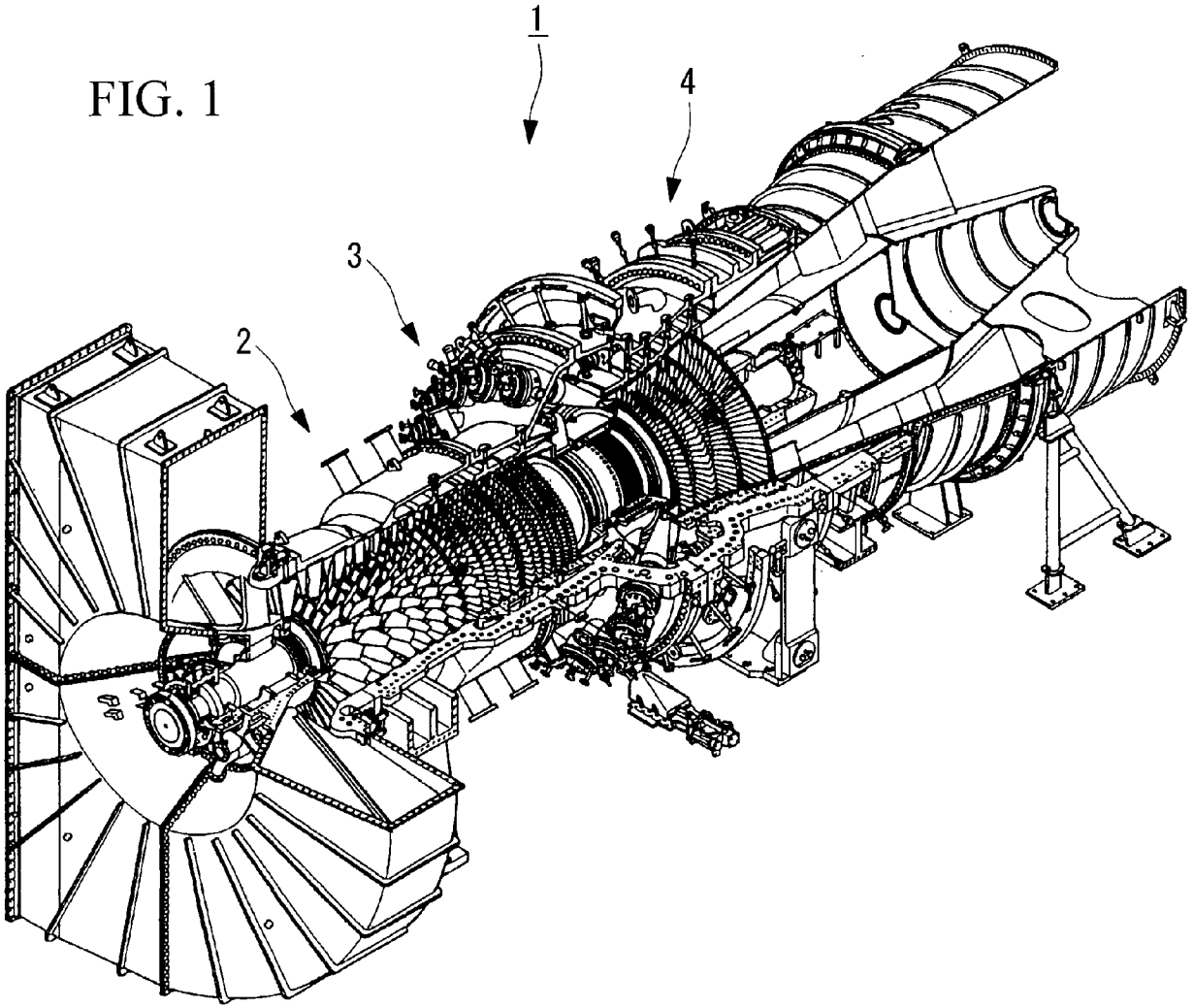
FIG. 1 is a perspective view schematically illustrating a gas turbine equipped with a turbine blade according to the present invention, showing a state where an upper portion of a casing is removed.

1: gas turbine
10: turbine blade
11: air foil
14: film-cooling hole
15: rib (first rib)
16: rib (second rib)
24: inner wall surface (inner peripheral surface)
30: impingement plate (first impingement plate) (the pressure adjustment member)
33: outer wall surface (outer peripheral surface)
36: impingement plate (second impingement plate) (the pressure adjustment member)
50: turbine blade
60: turbine blade
C1: cavity
C2: cavity
C3: cavity
C4: cavity
C5: cavity
L.E.: leading edge
T.E.: trailing edge

BEST MODE FOR CARRYING OUT THE INVENTION

A first embodiment of a turbine blade according to the present invention will be described below with reference to FIGS. 1 to 5.

Figure 2:
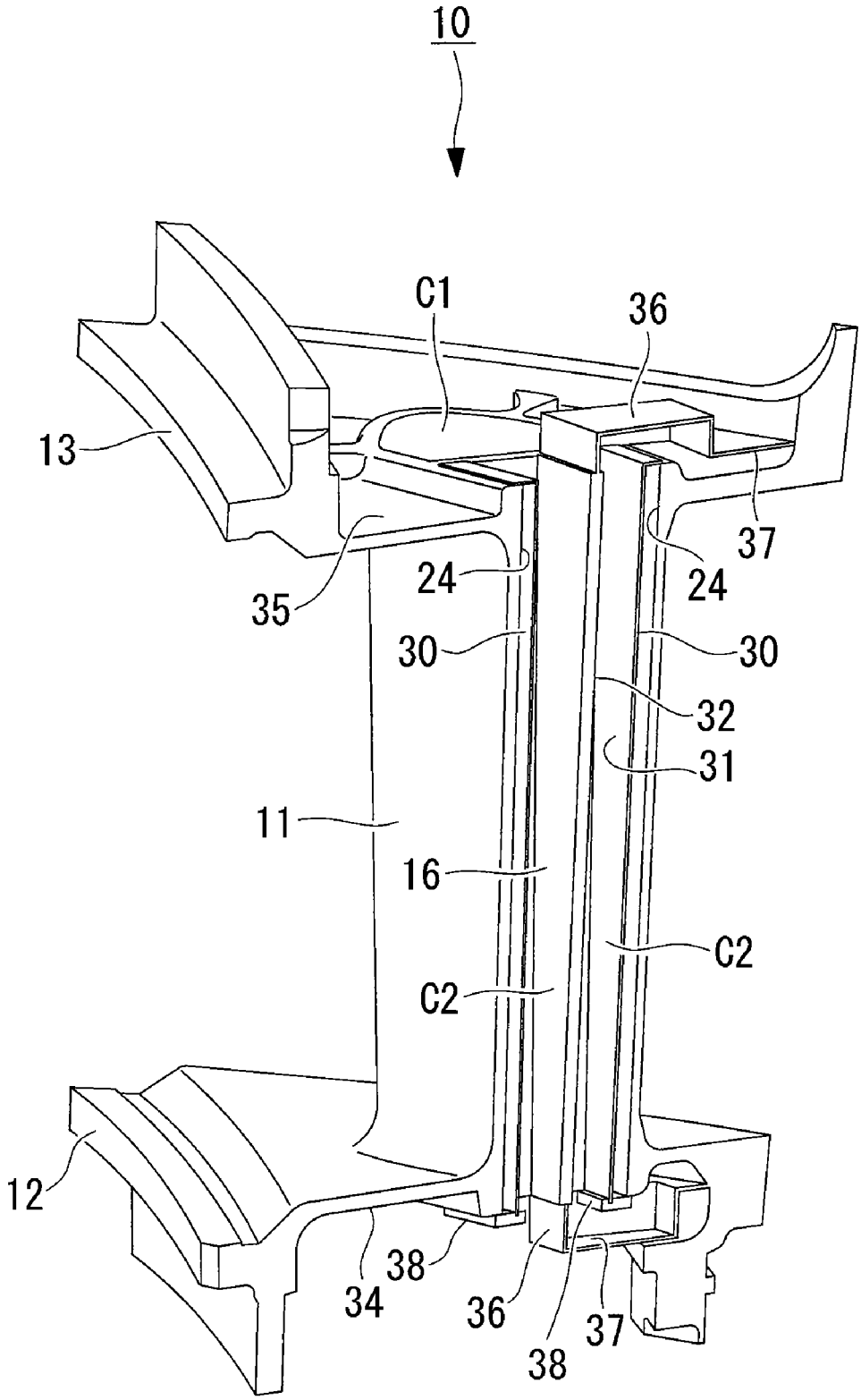
FIG. 2 is a perspective view of a relevant part of the turbine blade according to a first embodiment of the present invention, taken along a plane substantially orthogonal to a center line connecting a leading edge and a trailing edge thereof.
Figure 3:
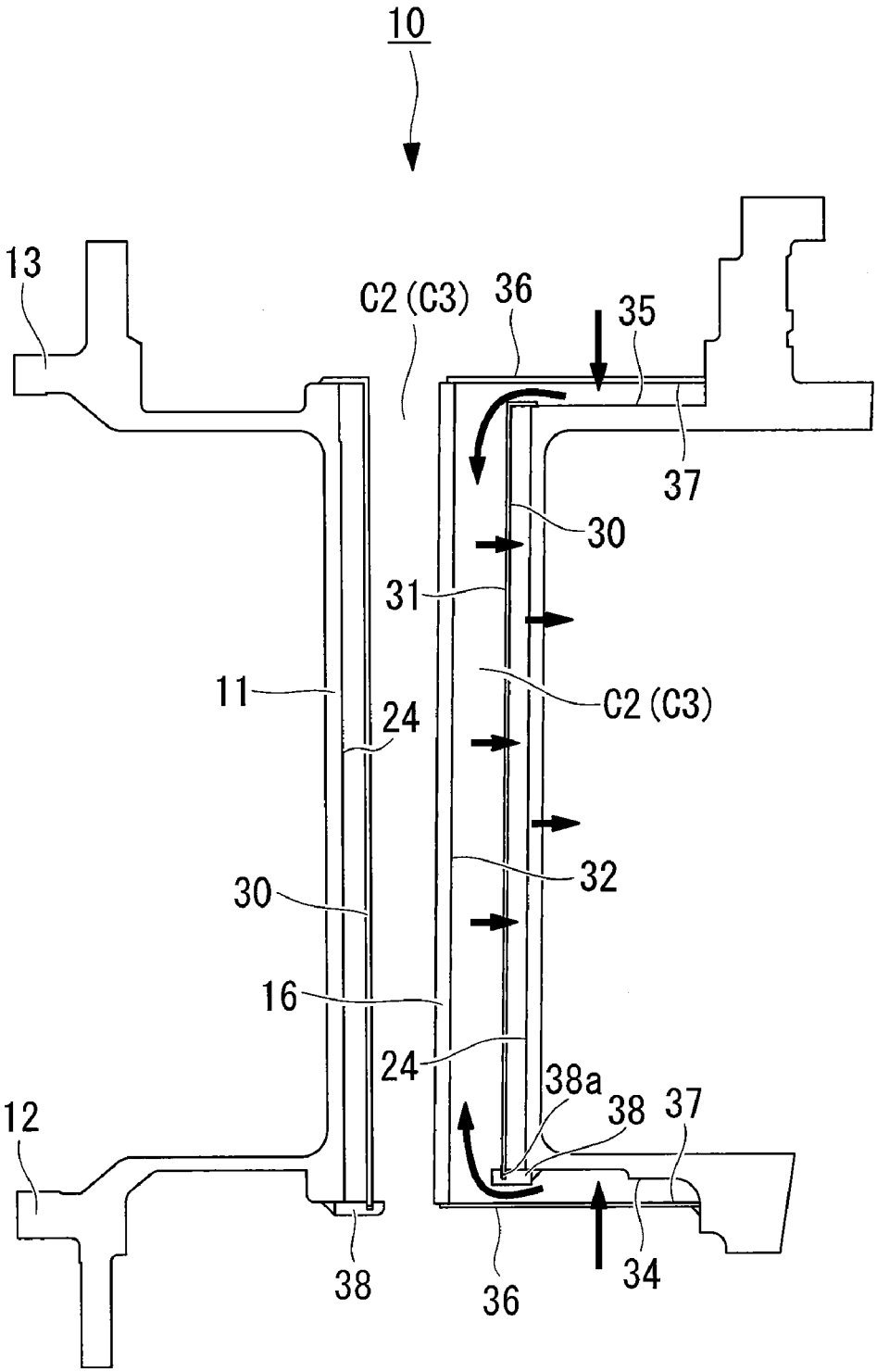
FIG. 3 is a cross-sectional view of the relevant part of the turbine blade according to the first embodiment of the present invention, taken along the plane substantially orthogonal to the center line connecting the leading edge and the trailing edge thereof.
Figure 4:
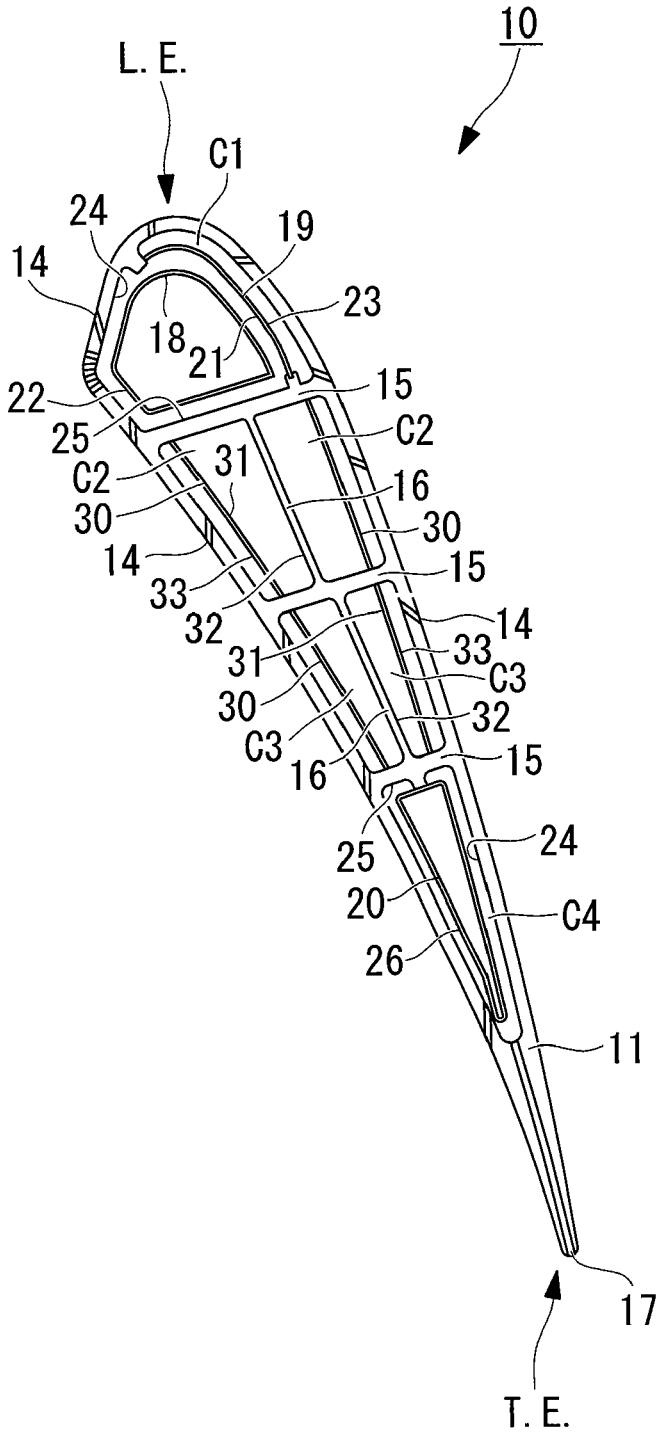
FIG. 4 is a cross-sectional view of a relevant part of substantially the midsection of the turbine blade according to the first embodiment of the present invention, taken along a plane substantially orthogonal to an axis extending in the vertical direction thereof.
Figure 5:
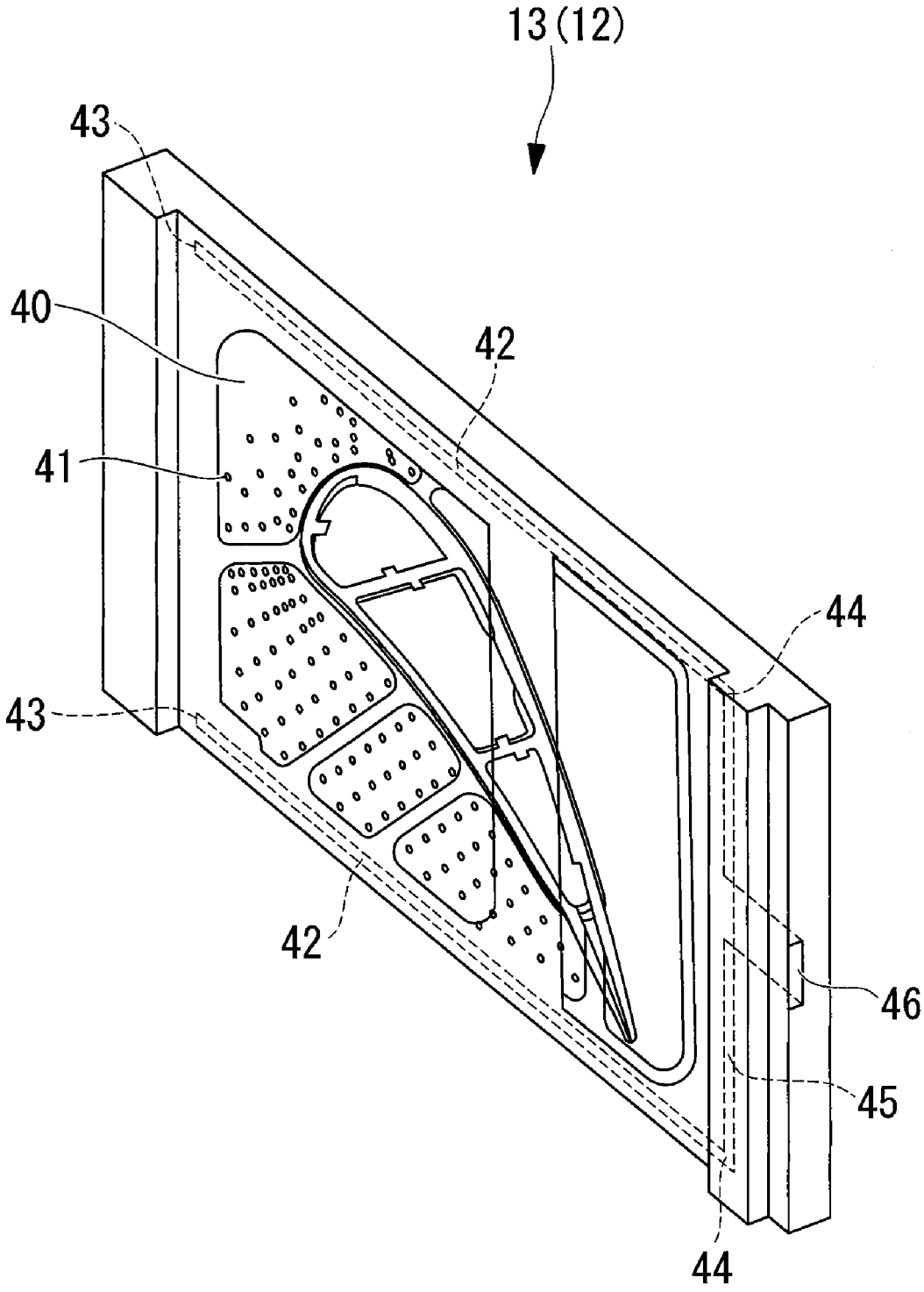
FIG. 5 is a perspective view of an outer shroud of the turbine blade according to the first embodiment of the present invention, as viewed from the outside.

FIG. 1 is a perspective view schematically illustrating a gas turbine equipped with the turbine blade according to the present invention, showing a state where an upper portion of a casing is removed. FIG. 2 is a perspective view of a relevant part of the turbine blade according to this embodiment, taken along a plane substantially orthogonal to a center line connecting a leading edge and a trailing edge thereof. FIG. 3 is a cross-sectional view of the relevant part of the turbine blade according to this embodiment, taken along the plane substantially orthogonal to the center line connecting the leading edge and the trailing edge thereof. FIG. 4 is a cross-sectional view of a relevant part of substantially the midsection of the turbine blade according to this embodiment, taken along a plane substantially orthogonal to an axis extending in the vertical direction thereof. FIG. 5 is a perspective view of an outer shroud of the turbine blade according to this embodiment, as viewed from the outside (the outer peripheral side).

As shown in FIG. 1, a gas turbine 1 is mainly constituted by a compression unit 2 that compresses combustion air, a combustion unit 3 that sprays fuel into high-pressure air sent from the compression unit 2 and combusts the air and fuel so as to generate high-temperature combustion gas, and a turbine unit 4 that is located downstream of the combustion unit 3 and is driven by the combustion gas output from the combustion unit 3.

A turbine blade 10 according to this embodiment is applicable to, for example, a first-stage vane in the turbine unit 4 and includes a air foil 11, an inner shroud 12, and an outer shroud 13, as shown in FIGS. 2 and 3.

As shown in FIG. 4, the air foil 11 is provided with a plurality of film-cooling holes 14, tabular ribs (first ribs) 15 that partition the interior of the air foil 11 into a plurality of (four in this embodiment) cavities C1, C2, C3, and C4 and provided substantially orthogonally to a center line (not shown) connecting a leading edge L.E. and a trailing edge T.E. in a cross section taken substantially orthogonally to an axis extending in the vertical direction of the air foil 11, tabular ribs (second ribs) 16 that partition (substantially bisect) each of the cavities C2 and C3 located in the midsection (the cavities other than the cavity C1 located most adjacent to the leading edge and the cavity C4 located most adjacent to the trailing edge) into the pressure side and the suction side, and an air hole 17 that has a plurality of pin fins (not shown) and guides cooling air (a cooling medium) in the cavity C4 located most adjacent to the trailing edge outward from the air foil 11.

The tabular ribs 16 prevent the cooling air from moving from the pressure side towards the suction side within the blade, and therefore has an effect of making the pressure within the cavities at the suction side differ from the pressure within the cavities at the pressure side.

The cavity C1 located most adjacent to the leading edge contains (accommodates) an insert 18 and an impingement plate 19, and the cavity C4 located most adjacent to the trailing edge contains (accommodates) an insert 20.

The inserts 18 and 20 have a hollow shape provided with a plurality of impingement-cooling holes (not shown), and the impingement plate 19 has a tabular shape provided with a plurality of impingement-cooling holes (not shown).

The insert 18 is disposed at the pressure side inside the cavity C1, whereas the impingement plate 19 is disposed such that an inner wall surface (inner peripheral surface) 21 thereof faces an outer wall surface (outer peripheral surface) 22 located at the suction side of the insert 18 and an outer wall surface (outer peripheral surface) 23 thereof faces an inner wall surface 24 located at the suction side of the air foil 11.

Cooling spaces, that is, cooling-air passages, are respectively formed between the outer wall surface 22 of the insert 18 and the inner wall surface 24 located at the pressure side of the air foil 11; between the outer wall surface 22 of the insert 18 and a wall surface 25 of one of the ribs 15; between the outer wall surface 22 of the insert 18 and the inner wall surface 21 of the impingement plate 19; and between the outer wall surface 23 of the impingement plate 19, the inner wall surface 24 located at the suction side of the air foil 11, and the wall surface 25 of one of the ribs 15.

The insert 20 is disposed within the cavity C4, and cooling spaces, that is, cooling-air passages, are respectively formed between an outer wall surface (outer peripheral surface) 26 of the insert 20 and the inner wall surface 24 of the air foil 11, as well as between the outer wall surface 26 of the insert 20 and a wall surface 25 of one of the ribs 15.

Cooling air is introduced into the inserts 18 and 20 by using means not shown in the drawings and is blown into the cooling spaces via the plurality of impingement-cooling holes so that the inner wall surface 24 of the air foil 11 is impingement-cooled.

The cooling air, after impingement-cooling the inner wall surface 24 of the air foil 11, is blown out from the plurality of film-cooling holes 14 of the air foil 11 so as to form a film of cooling air around the air foil 11, thereby film-cooling the air foil 11.

Moreover, the cooling air is blown out from the trailing edge of the air foil 11 through the air hole 17 while cooling the pin fins so as to cool the vicinity of the trailing edge of the air foil 11.

Furthermore, after the cooling air is introduced into the insert 18 and blown into the cooling spaces via the impingement-cooling holes that are open towards the inner wall surface 24 at the pressure side of the air foil 11 so as to impingement-cool the inner wall surface 24 at the pressure side of the air foil 11, a portion of the cooling air is made to flow into the cooling space formed between the outer wall surface 22 of the insert 18 and the inner wall surface 21 of the impingement plate 19 via the cooling space formed between the outer wall surface 22 of the insert 18 and the inner wall surface 24 of the air foil 11 and the cooling space formed between the outer wall surface 22 of the insert 18 and the wall surface 25 of the corresponding rib 15. Then, the cooling air flowing into the cooling space formed between the outer wall surface 22 of the insert 18 and the inner wall surface 21 of the impingement plate 19 is blown into the cooling spaces via the impingement-cooling holes that are open towards the inner wall surface 24 at the suction side of the air foil 11, so as to impingement-cool the inner wall surface 24 at the suction side of the air foil 11, and is subsequently blown out from the film-cooling holes 14.

On the other hand, the cavities C2 and C3 located in the midsection each contain (accommodate) an impingement plate 30.

Each impingement plate 30 (the pressure adjustment member) has a tabular shape provided with a plurality of impingement-cooling holes (not shown), and is disposed such that an inner wall surface (inner peripheral surface) 31 thereof faces a wall surface 32 of the corresponding rib 16 and an outer wall surface (outer peripheral surface) 33 thereof faces the inner wall surface 24 of the air foil 11.

Cooling spaces, that is, cooling-air passages, are formed between the outer wall surfaces 33 of the impingement plates 30, the inner wall surface 24 of the air foil 11, and the wall surfaces 25 of the ribs 15.

As shown in FIGS. 2 and 3, the inner shroud 12 is provided at the inner side (inner peripheral side) of the air foil 11, whereas the outer shroud 13 is provided at the outer side (outer peripheral side) of the air foil 11.

A surface (lower surface in FIGS. 2 and 3) 34 of the inner shroud 12 and a surface (upper surface in FIGS. 2 and 3) 35 of the outer shroud 13 are each provided with an impingement plate 36 (the pressure adjustment member).

Each impingement plate 36 has a tabular shape provided with a plurality of impingement-cooling holes (not shown), and is disposed so as to cover the upper side or the lower side of spaces formed, at the suction side relative to the wall surfaces 32 of the ribs 16, in the cavities C2 and C3 located in the midsection (namely, spaces surrounded by the wall surfaces 25 of the ribs 15, the wall surfaces 32 of the ribs 16, and the inner wall surface 24 of the air foil 11).

Cooling spaces, namely, cooling-air passages, that guide the cooling air passing through the impingement-cooling holes formed in the impingement plates 36 toward the spaces formed, at the suction side relative to the wall surfaces 32 of the ribs 16, in the cavities C2 and C3 located in the midsection are respectively formed between inner wall surfaces 37 of the impingement plates 36 and the surface 34 of the inner shroud 12, as well as between the inner wall surfaces 37 of the impingement plates 36 and the surface 35 of the outer shroud 13.

The spaces formed, at the suction side relative to the wall surfaces 32 of the ribs 16, in the cavities C2 and C3 located in the midsection can be supplied with only the cooling air passing through the impingement-cooling holes formed in the impingement plates 36.

Furthermore, the cooling air, after impingement-cooling the impingement plates 36, flows into the spaces formed, at the suction side relative to the wall surfaces 32 of the ribs 16, in the cavities C2 and C3 located in the midsection and is blown into the cooling spaces via the impingement-cooling holes that are open towards the inner wall surface 24 at the suction side of the air foil 11, so as to impingement-cool the inner wall surface 24 at the suction side of the air foil 11. Subsequently, the cooling air is blown out from the film-cooling holes 14.

As shown in FIG. 3, inlet sections, adjacent to the inner shroud 12, for the spaces formed, at the suction side relative to the wall surfaces 32 of the ribs 16, in the cavities C2 (C3) located in the midsection (namely, spaces formed between the wall surfaces 32 of the ribs 16 and the inner wall surfaces 31 of the corresponding impingement plates 30) respectively have impingement backing plates 38 fixed thereto along the inner wall surface 24 at the suction side and the pressure side of the air foil 11. In order to seal the cooling air while absorbing thermal expansion differences in the impingement plates 30 in the vertical direction of the blade, one end of each impingement plate 30 (a lower end in FIG. 3) is configured to be fitted in a groove 38*a* provided in the corresponding impingement backing plate 38. By sliding the one end of the impingement plate 30 within the groove 38*a*, the impingement plate 30 can be expanded or contracted in the vertical direction of the blade.

Furthermore, as shown in FIG. 5, the surface 34 of the inner shroud 12 (see FIGS. 2 and 3) and the surface 35 of the outer shroud 13 (see FIGS. 2 and 3) are each provided with an impingement plate 40(36).

Each impingement plate 40 (36) has a tabular shape provided with a plurality of impingement-cooling holes 41 and is disposed so as to cover the upstream pressure side and the upstream leading-edge side of the air foil 11 from above or below.

Cooling spaces, namely, cooling-air passages, that guide the cooling air passing through the impingement-cooling holes 41 formed in the impingement plates 40 (36) toward leading-edge opening ends 43 of side channels 42 are respectively formed between an inner wall surface (not shown) of one impingement plate 40(36) and the surface 34 of the inner shroud 12, as well as between the inner wall surface (not shown) of the other impingement plate 40 (36) and the surface 35 of the outer shroud 13.

The side channels 42 are cooling-air passages formed along both sides of each of the inner shroud 12 and the outer shroud 13 from the leading edge toward the trailing edge, and trailing-edge opening ends 44 thereof are connected to an end section that corresponds to a header 45 formed in a trailing-edge section of each of the inner shroud 12 and the outer shroud 13 along the width direction thereof. An inner wall surface of each side channel 42 is provided with a plurality of tabular protrusions (turbulators), which are not shown.

The header 45 is a cooling-air passage that guides the cooling air, flowing into the side channels 42 from the leading-edge opening ends 43 of the side channels 42, toward a trailing-edge channel 46 formed in the trailing-edge section of each of the inner shroud 12 and the outer shroud 13.

The cooling air passing through the impingement-cooling holes 41 formed in each impingement plate 40 (36) flows into the side channels 42 from the leading-edge opening ends 43 of the side channels 42, passes through the side channels 42, the headers 45, and the trailing-edge channels 46, and is subsequently released from the trailing edges of the inner shroud 12 and the outer shroud 13. In this case, the leading edges, both side sections, and the trailing edges of the inner shroud 12 and the outer shroud 13 are cooled by the cooling air.

In the turbine blade 10 having such a configuration, the cooling air supplied (blown out) towards the impingement plates 36 impingement-cools the impingement plates 36, then passes through the impingement-cooling holes formed in the impingement plates 36, travels through the cooling spaces formed between the inner wall surface 37 of one impingement plate 36 and the surface 34 of the inner shroud 12 and between the inner wall surface 37 of the other impingement plate 36 and the surface 35 of the outer shroud 13 so as to flow into the spaces located at the suction side of the cavities C2 and C3 in the midsection and formed by the wall surfaces 25 of the ribs 15, the wall surfaces 32 of the ribs 16, and the inner wall surfaces 31 of the impingement plates 30. The cooling air flowing into the spaces located at the suction side of the cavities C2 and C3 in the midsection and formed by the wall surfaces 25 of the ribs 15, the wall surfaces 32 of the ribs 16, and the inner wall surfaces 31 of the impingement plates 30 is blown into the cooling spaces formed by the outer wall surfaces 33 of the impingement plates 30, the wall surfaces 25 of the ribs 15, and the inner wall surface 24 at the suction side of the air foil 11 via the impingement-cooling holes, which are provided at the suction side of the cavities C2 and C3 and are open towards the inner wall surface 24 at the suction side of the air foil 11, so as to impingement-cool the inner wall surface 24 at the suction side of the air foil 11. Subsequently, the cooling air is blown out from the film-cooling holes 14.

On the other hand, cooling air is directly introduced (supplied) into spaces located at the pressure side cavity C2 and C3 without intervention of the second impingement plate 36 provided on the inner shroud 12 and the outer shroud 13 by the wall surfaces 25 of the ribs 15, the wall surfaces 32 of the ribs 16, and the inner wall surfaces 31 of the impingement plates 30 by using means not shown in the drawings. The cooling air flowing into the spaces located at the pressure side of the cavities C2 and C3 and formed by the wall surfaces 25 of the ribs 15, the wall surfaces 32 of the ribs 16, and the inner wall surfaces 31 of the impingement plates 30 is blown into the cooling spaces formed by the outer wall surfaces 33 of the impingement plates 30, the wall surfaces 25 of the ribs 15, and the inner wall surface 24 at the pressure side of the air foil 11 via the impingement-cooling holes that are provided at the pressure side of the cavities C2 and C3 and are open towards the inner wall surface 24 at the pressure side of the air foil 11, so as to impingement-cool the inner wall surface 24 at the pressure side of the air foil 11. Subsequently, the cooling air is blown out from the film-cooling holes 14.

Specifically, the passages for cooling air supplied to the cavities C2 and C3 at the pressure side and flowing out of the film-cooling holes 14 at the pressure side of the air foil 11 do not include second impingement plates 36 but include only first impingement plates 30 as pressure adjustment members.

On the other hand, as mentioned above, the passages for cooling air supplied to the cavities C2 and C3 at the suction side and flowing out of the film-cooling holes 14 at the suction side of the air foil 11 include second impingement plates 36 and first impingement plates 30 as pressure adjustment_ members.

With the configuration of such a turbine blade 10, the cooling air supplied to the cavities C2 and C3 at the suction side travels via the pressure adjustment members constituted by the first impingement plates 30 and the second impingement plates 36 so as to flow out of the film-cooling holes 14 at the suction side of the air foil 11. On the other hand, the passages for the cooling air supplied to the cavities C2 and C3 at the pressure side are equipped only with first impingement plates 30, as pressure adjustment members, provided downstream of the cavities and facing the inner wall surface 24 of the air foil 11. In consequence, the pressure in the cavities C2 and C3 at the pressure side becomes higher, whereas the pressure in the cavities C2 and C3 at the suction side becomes lower, so that the amount of cooling air flowing out of the film-cooling holes 14 at the suction side of the air foil 11 is reduced, whereby the amount of cooling air in the air foil 11 can be optimized.

The cooling air introduced into the inserts 18 and 20 by using means that are not shown is blown into the cooling spaces via the plurality of impingement holes so as to impingement-cool the inner wall surface 24 of the air foil 11.

The cooling air, after impingement-cooling the inner wall surface 24 of the air foil 11, is blown out from the plurality of film-cooling holes 14 of the air foil 11 so as to form a film of cooling air around the air foil 11, thereby film-cooling the air foil 11.

Furthermore, in the turbine blade 10 according to this embodiment, after the cooling air is introduced into the insert 18 and blown into the cooling spaces via the impingement-cooling holes that are open towards the inner wall surface 24 at the pressure side of the air foil 11 so as to impingement-cool the inner wall surface 24 at the pressure side of the air foil 11, a portion of the cooling air passes through the cooling space formed between the outer wall surface 22 of the insert 18 and the inner wall surface 24 of the air foil 11 and the cooling space formed between the outer wall surface 22 of the insert 18 and the wall surface 25 of the corresponding rib 15 so as to flow into the cooling space formed between the outer wall surface 22 of the insert 18 and the inner wall surface 21 of the impingement plate 19. The cooling air flowing into the cooling space formed between the outer wall surface 22 of the insert 18 and the inner wall surface 21 of the impingement plate 19 is blown into the cooling spaces via the impingement holes that are open towards the inner wall surface 21 at the suction side of the air foil 11, so as to impingement-cool the inner wall surface 24 at the suction side of the air foil 11, and is subsequently blown out from the film-cooling holes 14.

Furthermore, after the cooling air is introduced into the insert 20 and blown into the cooling spaces via the impingement-cooling holes that are open towards the inner wall surface 24 of the air foil 11 so as to impingement-cool the inner wall surface 24 of the air foil 11, a portion of the cooling air passes through the cooling space formed between the outer wall surface 26 of the insert 20 and the inner wall surface 24 of the air foil 11 and through the air hole 17 so as to cool the pin fins, and is subsequently blown out from the trailing edge of the air foil 11.

Moreover, in the turbine blade 10 according to this embodiment, the cooling air passing through the impingement-cooling holes 41 formed in the impingement plates 40 (36) uniformly flows toward the leading-edge opening ends 43 of the side channels 42, and the cooling air flowing into the side channels 42 from the leading-edge opening ends 43 of the side channels 42 passes through the side channels 42, which are linear channels, and the headers 45 and is subsequently released from the trailing edges of the inner shroud 12 and the outer shroud 13 via the trailing-edge channels 46.

With the turbine blade 10 according to this embodiment, the cooling air, after impingement-cooling the impingement plates 36, is used for impingement-cooling the inner wall surface 24 at the suction side of the air foil 11, as well as for film-cooling the outer wall surface (outer peripheral surface) at the suction side of the air foil 11.

Accordingly, the amount of cooling air flowing into the spaces located at the suction side of the cavities C2 and C3 in the midsection and formed by the wall surfaces 25 of the ribs 15, the wall surfaces 32 of the ribs 16, and the inner wall surfaces 31 of the impingement plates 30 can be reduced so that the overall amount of cooling air (consumption level of cooling air) can be reduced, and cooling air with low temperature and whose cooling capacity is not sufficiently utilized can be prevented from being blown out from the film-cooling holes 14.

Furthermore, with the turbine blade 10 according to this embodiment, cooling air with low pressure and low flow velocity is blown out from the film-cooling holes 14 formed at the suction side of the cavities C2 and C3 located in the midsection so that a highly persistent cooling air film is uniformly formed air along the outer wall surface at the suction side of the air foil 11.

Consequently, the heat transmission from the combustion gas (high-temperature gas) to the surface of the air foil 11 (more specifically, the outer wall surface at the suction side of the air foil 11) can be reduced, thereby improving the film cooling efficiency.

Furthermore, with the turbine blade 10 according to this embodiment, since the channels that guide the cooling air flowing in from the leading-edge opening ends 43 of the side channels 42 towards the trailing edges of the inner shroud 12 and the outer shroud 13 (downstream opening ends of the trailing-edge channels 46) each have only two bent sections, namely, a joint (communication) section between the trailing-edge opening end 44 of the side channel 42 and an end of the header 45 and a joint (communication) section between a midsection of the header 45 and an upstream opening end of the trailing-edge channel 46, a loss of pressure (channel resistance) occurring at the bent sections of the channel can be reduced, thereby increasing the flow velocity of the cooling air and efficiently cooling the inner shroud 12 and the outer shroud 13. In addition, the amount of cooling air flowing into the cooling spaces formed between the inner wall surface of one impingement plate 40 (36) and the surface 34 of the inner shroud 12 and between the inner wall surface of the other impingement plate 40 (36) and the surface 35 of the outer shroud 13 can be reduced, whereby the overall amount of cooling air (consumption level of cooling air) can be further reduced.

In the gas turbine 1 equipped with the turbine blade 10 according to this embodiment, since unnecessary cooling air that does not contribute to the cooling of the gas turbine is mixed with the combustion gas and thus does not lower the temperature of the combustion gas, the performance of the gas turbine can be enhanced. In addition, by reducing the amount of cooling air extracted from the compressor part, the reduced overall amount of compressed air can be used as air for gas combustion, whereby the amount of combustion gas to be introduced and completely combusted can be increased. In consequence, since the total amount of combustion gas increases, the turbine output can be improved without having to increase the size of the compressor part, and size reduction and high output of the turbine can be achieved, thereby advantageously resulting in higher performance. Because the ribs 16 contribute to the improvement in the strength of the blade, the blade can advantageously be reduced in thickness. Moreover, optimization of the amount of cooling air at the suction side and the pressure side of the blade can advantageously be controlled independently with a simple structure.

Figure 6:
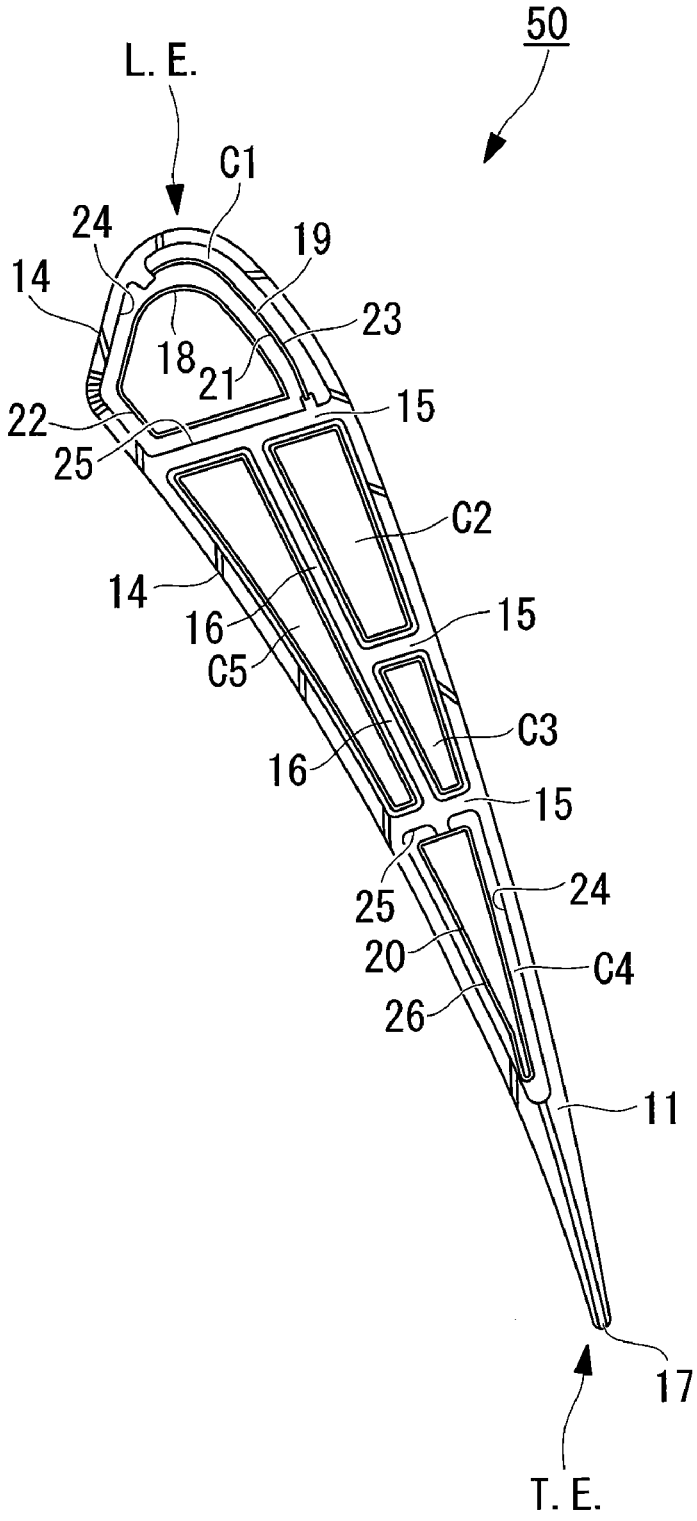
FIG. 6 is a cross-sectional view of a relevant part of substantially the midsection of a turbine blade according to a second embodiment of the present invention, taken along a plane substantially orthogonal to an axis extending in the vertical direction thereof.

A second embodiment of the turbine blade according to the present invention will now be described with reference to FIG. 6. FIG. 6 is a cross-sectional view of a relevant part of substantially the midsection of the turbine blade according to this embodiment, taken along a plane substantially orthogonal to an axis extending in the vertical direction thereof.

As shown in FIG. 6, a turbine blade 50 according to this embodiment differs from that in the above-described embodiment in that a single cavity C5 is provided in place of two of the cavities C2 and C3 (cavities other than the cavity C1 located most adjacent to the leading edge and the cavity C4 located most adjacent to the trailing edge) located at the pressure side of the midsection. Since other components are the same as those in the above-described embodiment, the description of those components will be omitted.

In this embodiment, the tabular ribs 15 and the tabular ribs 16 are formed such that the rib 15 that partitions the cavities C2 and C3 located at the suction side of the midsection respectively into the leading-edge side and the trailing-edge side and the ribs 16 that partition (substantially bisect) the cavities C2 and C3 located at the suction side of the midsection and the cavity C5 located at the pressure side of the midsection respectively into the pressure side and the suction side intersect with each other so as to form a T-shape (that is, the rib 15 and the ribs 16 substantially form a T-shape in cross section).

With the turbine blade 50 according to this embodiment, since the cavities C2 and C3 located at the suction side of the midsection are respectively partitioned into the leading-edge side and the trailing-edge side by the rib 15, the strength against bulging stress can be enhanced at the suction side.

Furthermore, with the turbine blade 50 according to this embodiment, since a rib 15 for partitioning a cavity located at the pressure side of the midsection into the leading-edge side and the trailing-edge side is not necessary, the structure of the cavity C5 located at the pressure side of the midsection can be simplified, thereby allowing for an easier casting process during manufacturing and a reduction in the manufacturing costs.

Moreover, with the turbine blade 50 according to this embodiment, since the number of ribs 15, which are difficult to cool, is reduced, the cooling efficiency of the cavity C5 located at the pressure side of the midsection can be enhanced.

Other advantages are the same as those in the above-described embodiment, and a description thereof will thus be omitted.

Figure 7:
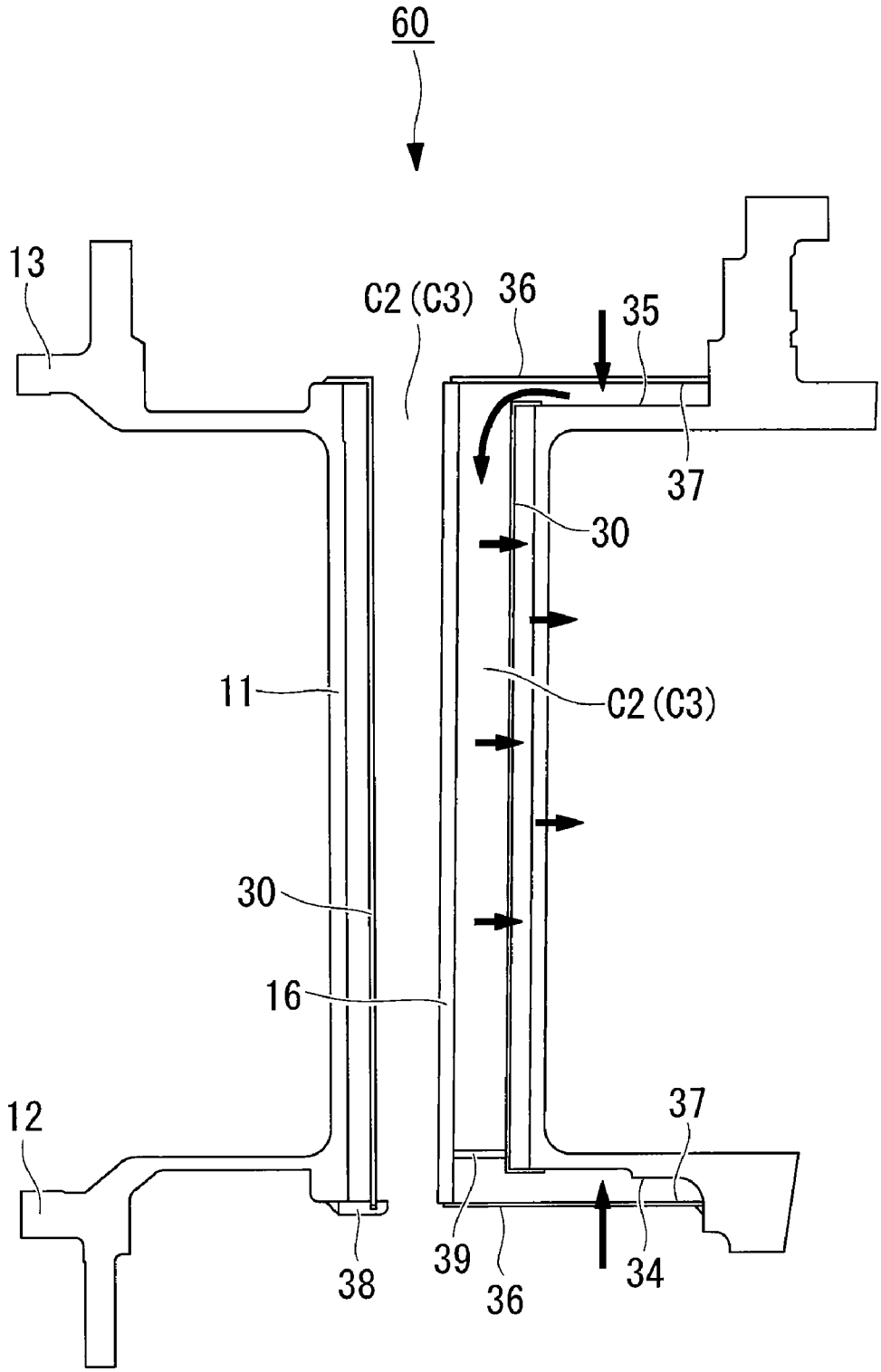
FIG. 7 is a cross-sectional view of a relevant part of a turbine blade according to a third embodiment of the present invention, taken along a plane substantially orthogonal to a center line connecting a leading edge and a trailing edge thereof.

A third embodiment of the turbine blade according to the present invention will now be described with reference to FIG. 7. FIG. 7 is a cross-sectional view of a relevant part of the turbine blade according to this embodiment, taken along a plane substantially orthogonal to a center line connecting a leading edge and a trailing edge thereof.

As shown in FIG. 7, a turbine blade 60 according to this embodiment differs from those in the above-described embodiments in that a partition plate 39 is provided in place of the impingement backing plate 38 provided on a side of the space formed in each cavity C2 (C3), located in the midsection, at the suction side relative to the wall surface 32 of the corresponding rib 16. Since other components are the same as those in the above-described embodiments, the description of those components will be omitted.

Specifically, the above-described embodiments employ a so-called "double-side supply method" in which the cooling air, after impingement-cooling the impingement plates 36 respectively provided in the inner shroud 12 and the outer shroud 13, flows into the space formed in each cavity C2 (C3), located in the midsection, at the suction side relative to the wall surface 32 of the corresponding rib 16, as shown in FIG. 2 or 3.

In contrast, in this embodiment, of the spaces formed in the cavities C2 (C3) located in the midsection, at the suction side relative to the wall surfaces 32 of the ribs 16, the space that is closer to the leading edge communicates, at one side (the upper side in FIG. 7), with the outer shroud 13 and is blocked, at the other side (the lower side in FIG. 7), by a partition plate 39 fixed to one end (lower end in FIG. 7) of the corresponding impingement plate 30, as shown in FIG. 7. At the same time, the space that is closer to the trailing edge communicates, at the other side, with the inner shroud 12 and is blocked, at one side, by a partition plate 39 (not shown) fixed to the other end (upper end in FIG. 7) of the other impingement plate 30. In other words, a so-called "single-side supply method" is employed in which the cooling air to be supplied to the space closer to the leading edge only includes cooling air that has impingement-cooled the impingement plate 36 of the outer shroud 13, but is not supplied from the inner shroud 12 side. On the other hand, the cooling air to be supplied to the space closer to the trailing edge only includes cooling air that has impingement-cooled the impingement plate 36 of the inner shroud 12, but the cooling air is not supplied from the outer shroud 13 side.

Alternatively, the space closer to the leading edge in this embodiment may communicate, at the other side, with the inner shroud 12 and be blocked, at one side, by the partition plate 39 fixed to the other end of the corresponding impingement plate 30, whereas the space closer to the trailing edge may communicate, at one side, with the outer shroud 13 and be blocked, at the other side, by the partition plate 39 (not shown) fixed to one end of the other impingement plate 30.

In the turbine blade 60 according to this embodiment, the partition plates 39 are each fixed in contact with the corresponding impingement plate 30 so that a seal is ensured at the joint section between the partition plate 39 and the impingement plate 30, thereby properly preventing the cooling air from leaking through the joint section.

Because the above-described embodiments have a structure in which one end of each impingement plate 30 is fitted in the corresponding impingement backing plate 38, the cooling air may sometimes slightly leak through between the one end of the impingement plate 30 and the groove 38*a* in the impingement backing plate 38.

Other advantages are the same as those in the above-described embodiments, and a description thereof will thus be omitted.

The present invention is not only applicable to a first-stage vane, but also to a vane or blade of another stage.

Although the above-described embodiments are directed to a specific example that includes the impingement plates 30 provided at the pressure side and the suction side within the cavities C2 and C3 located in the midsection, the ribs 16 that partition the spaces in the cavities C2 and C3 into the pressure side and the suction side along the center line, and the impingement plates 36 disposed upstream of the spaces located at the suction side of the ribs 16, the present invention is not limited to this example. Thus, for example, a configuration in which the impingement plates 30 are provided only at the suction side within the cavities C2 and C3 located in the midsection (a configuration not including the ribs 16, the impingement plates 30 at the pressure side, and the impingement plate 36 at the upstream side), a configuration including only the ribs 16 and the impingement plates 30 disposed at the suction side within the cavities C2 and C3 located in the midsection (a configuration not including the impingement plates 30 at the pressure side and the impingement plate 36 at the upstream side), or a configuration only including the ribs 16, the impingement plates 30 disposed at the suction side within the cavities C2 and C3 located in the midsection, and the impingement plates 36 (a configuration not including the impingement plates 30 at the pressure side) is permissible, or a configuration in which the flow rate is finely adjusted on the basis of the dimensions of an opening area of the suction-side and pressure-side impingement plates between vanes of different stages may be added.

Furthermore, the present invention is applicable not only to the cavities C2 and C3 located in the midsection (the cavities other than the cavity C1 located most adjacent to the leading edge and the cavity C4 located most adjacent to the trailing edge), but also to the cavity C1 located most adjacent to the leading edge and/or the cavity C4 located most adjacent to the trailing edge.

The invention claimed is:

1. A turbine blade, comprising:

a tabular rib that partitions the turbine blade into a pressure side and a suction side, the tabular rib being provided along a center line connecting a leading edge and a trailing edge of the turbine blade and between the leading edge and the trailing edge;

at least two cavities of which a cavity at the suction side and a cavity at the pressure side do not communicate with each other;

a passage for cooling air supplied to the cavity at the pressure side and flowing out of a film-cooling hole at the pressure side of an air foil; and a passage for cooling air supplied to the cavity at the suction side and flowing out of a film-cooling hole at the suction side of the air foil, wherein the passage for cooling air supplied to the cavity at the pressure side and the passage for cooling air supplied to the cavity at the suction side are provided with pressure adjustment members, and the number of pressure adjustment members provided in the passage for cooling air at the pressure side is smaller than the number of pressure adjustment members provided in the passage for cooling air at the suction side.

2. The turbine blade according to claim 1, wherein the pressure adjustment member provided in the passage for the cooling air supplied to the cavity at the pressure side and flowing out of the film-cooling hole at the pressure side of the air foil comprises an impingement plate provided downstream of cooling air flowing out of the cavity at the pressure side, and wherein the pressure adjustment member provided in the passage for the cooling air flowing out of the film-cooling hole at the suction side of the air foil comprises an impingement plate provided upstream of cooling air flowing into the cavity at the suction side and an impingement plate provided downstream of cooling air flowing out of the cavity at the suction side.

3. A gas turbine comprising the turbine blade according to claim 1.

4. The gas turbine according to claim 3, wherein the diameter of impingement holes varies between stages.

* * * * *